US006107740A

United States Patent [19]

Morimoto et al.

[11] Patent Number: 6,107,740

[45] Date of Patent: Aug. 22, 2000

[54] PLUGGING STRUCTURE FOR VESSELS

[75] Inventors: Yukihiro Morimoto; Yukiharu Tagawa; Hiromitu Matuno, all of Himeji, Japan

[73] Assignee: Ushiodenki Kabushiki Kaisha, Tokyo, Japan

[21] Appl. No.: 09/142,180

[22] PCT Filed: Jun. 22, 1998

[86] PCT No.: PCT/JP98/02760

§ 371 Date: Sep. 24, 1998

§ 102(e) Date: Sep. 24, 1998

[87] PCT Pub. No.: WO99/00825

PCT Pub. Date: Jan. 7, 1999

[30] Foreign Application Priority Data

Jun. 30, 1997 [JP] Japan ..... 9-187157

[51] Int. Cl.[7] ..... H01J 17/18

[52] U.S. Cl. ..... 313/625; 313/626; 313/623

[58] Field of Search ..... 313/623, 624, 313/625, 626

[56] References Cited

U.S. PATENT DOCUMENTS 5,424,609 6/1995 Geven et al. ..... 313/623

FOREIGN PATENT DOCUMENTS 5-334997 12/1993 Japan .
9-115484 5/1997 Japan .
9-125186 5/1997 Japan .
10-40867 2/1998 Japan .
10-40868 2/1998 Japan .
10-40869 2/1998 Japan .
10-125284 5/1998 Japan .
10-172514 6/1998 Japan .
10-188897 7/1998 Japan .
WO 94/06947 3/1994 WIPO .

*Primary Examiner*—Vip Patel
*Attorney, Agent, or Firm*—Nixon Peabody LLP; David S. Safran

[57] ABSTRACT

In sealing body (6) of a tube lamp which seals side tube (3) which is connected to arc tube (2) and which securely holds upholding parts (7) of the electrodes by a shrink seal and which consists of a functional gradient material, in which an electrically conductive component and a dielectric component in the axial direction of the tube have a continuous or gradual concentration gradient, and in which one side is dielectric and the other side is electrically conductive, the object of the invention is achieved by upholding parts (7) of the electrodes being located in an opening of this functional gradient material without a gap in a shrink seal, and by the surface of the area of upholding parts (7) of the electrodes which are located in the opening of the functional gradient material being coated at least partially with thin layer (9) of a metal with a high melting point.

2 Claims, 1 Drawing Sheet

PLUGGING STRUCTURE FOR VESSELS

TECHNICAL FIELD

The invention relates to a sealing part arrangement of various tube lamps, such as a mercury lamp, a metal halide lamp, and halogen lamp and the like.

DESCRIPTION OF RELATED ART

Recently a functional gradient material has been used more and more often for a sealing body of a discharge lamp in which in a silica glass arc tube there is a pair of electrodes opposite one another. In this sealing body one of its ends is rich with a dielectric component such as silicon dioxide or the like, and in the direction to the other end the portion of an electrically conductive component such as molybdenum or the like increases continuously or gradually. In the sealing body consisting of silicon dioxide and molybdenum therefore one end is dielectric and has a coefficient of thermal expansion which is roughly equal to the coefficient of thermal expansion of the silica glass forming the arc tube, while the other end is electrically conductive and has the property that its coefficient of thermal expansion approaches the coefficient of thermal expansion of the tungsten forming the upholding parts of the electrodes. These properties are suitable for a sealing body of a discharge lamp. This sealing body can furthermore be used not only for a discharge lamp, but also for a halogen lamp provided with a luminous filament or halogen heating apparatus provided with a luminous filament.

Since a sealing body using this functional gradient material consists of a dielectric component, such as silicon dioxide or the like, and of an electrically conductive component, such as molybdenum or the like, it however happens that as a result of different coefficients of thermal expansion cracks form in the sealing body when the upholding parts of the electrodes of a metal such as tungsten or the like come into direct contact with the dielectric component. After producing the lamp, the size of these cracks grows; this also leads to failures such as fractures and the like.

To eliminate this defect, for example, in Japanese patent disclosure document HEI 9-125186 it was proposed that within the sealing body the dielectric component and the upholding parts of the electrodes not come into direct contact with one another, but there be gaps or the like present here.

These gaps are however connected to the discharge space and therefore form the coolest portion. When filled substances such as mercury and metal halides condense in this coolest portion, an undesirable phenomenon such as a change of the emission color of the lamp or the like occurs.

DISCLOSURE OF THE INVENTION

With respect to the above described circumstances, as claimed in the invention a sealing part arrangement (hereinafter also called "sealing body") for a tube lamp is given.

(1) In a sealing part arrangement of a tube lamp which seals a side tube which is connected to an arc tube and which securely holds the upholding parts of the electrodes by a shrink seal and which consists of a functional gradient material, in which an electrically conductive component and a dielectric component in the axial direction of the tube have a continuous or gradual concentration gradient, and in which one side is dielectric and the other side is electrically conductive, the invention is characterized in that the upholding parts of the electrodes are located in an opening of the above described functional gradient material without a gap in a shrink seal, and that the surface of the area of the upholding parts of the electrodes which are located in the opening of the functional gradient material is coated at least partially with a thin layer of a metal with a high melting point.

(2) The invention is furthermore characterized in that in the above described design (1) the metal with a high melting point is tungsten or molybdenum.

BEST MODE FOR CARRYING OUT THE INVENTION

Figure 1:
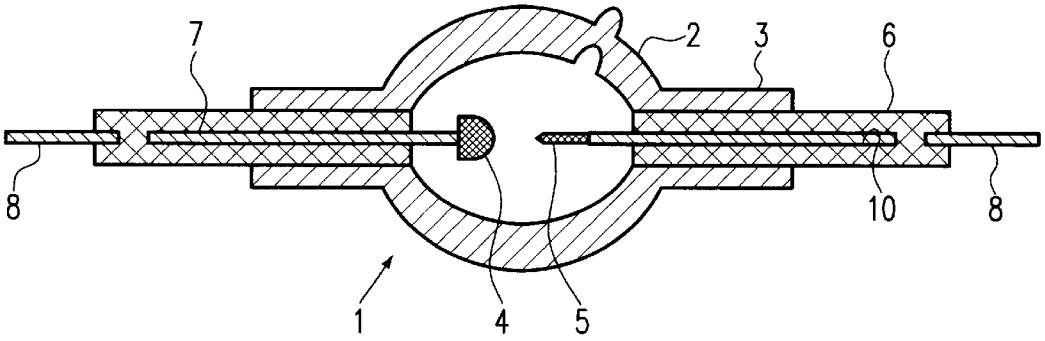
FIG. 1 shows a schematic of a discharge lamp for which sealing bodies as claimed in the invention are used.

FIG. 1 schematically shows a discharge lamp for which sealing bodies as claimed in the invention are used. In the figure reference number 1 labels a lamp with arc tube 2 and side tube 3 which consist of silica glass. In arc tube 2 a pair of electrodes 4 and 5 are located opposite one another. Reference number 6 labels a sealing body which is cylindrical and which consists of silicon dioxide and molybdenum. One side of sealing body 6 (the side towards the arc tube) is rich with silicon dioxide and is dielectric, while the other side (the side away from the arc tube) is rich with molybdenum and is electrically conductive.

The dielectric face is adjacent to the discharge space. Side tube 3 which is formed on the two ends of arc tube 2 is hermetically welded in the areas of sealing body 6 which are rich with silicon dioxide, i.e. in the dielectric areas. Reference number 8 labels an outer lead.

Furthermore, reference number 7 labels upholding parts of the electrodes which are attached as follows in the sealing body consisting of a functional gradient material.

First, a green compact of a silicon dioxide and molybdenum powder undergoes temporary sintering at a temperature of roughly 1300° C. so that a cylinder is formed. In this cylinder, on the dielectric face, opening 10 for insertion of the upholding parts of the electrodes is machined roughly centered and extends from the surface of the face to the electrically conductive area of the sealing body and has a diameter roughly equal to the upholding parts of the electrodes. Afterwards, the upholding parts 7 of electrodes are inserted into opening 10 and undergo complete sintering at roughly 1700° C.

Figure 2:
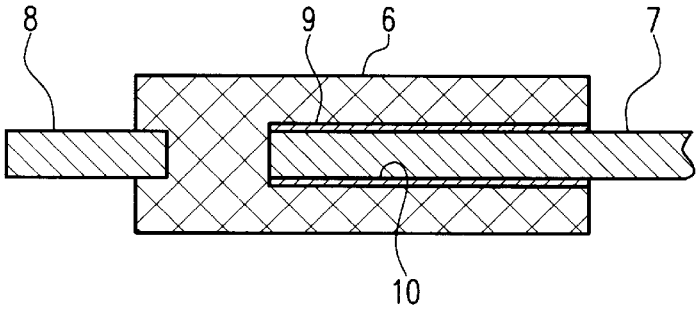
FIG. 2 shows a schematic of the sealing body as claimed in the invention.

FIG. 2 schematically shows the sealing body as claimed in the invention in cross section. Sealing body 6 consists of a functional gradient material consisting of silicon dioxide and molybdenum and is produced by a wetting method, a pressing process or the like.

In the wetting method, using a silicon dioxide powder and a molybdenum powder with particle size distributions which differ from one another, a mixed slurry is obtained. After centrifuging and sedimentation of the mixed slurry the sludge is dewatered after removing the solvent, dried and subject to cold hydrostatic forming or a similar process. In this production process in the longitudinal direction of the functional gradient material an extremely gentle change of composition is obtained.

In the pressing process several types of a mixed powder with different mixing ratios of the silicon dioxide powder and molybdenum are prepared. Wet mixing of the respective mixed powder with a solvent which contains an organic binder is done. Afterwards drying is done and a granulated powder produced with which a casting mold in the sequence of the mixing ratio is filled layer by layer. After pressing and a compacted body have been obtained, by heating the compacted body the organic binder is removed from it and burning is done.

The functional gradient material produced by the above described process is molded into the shape of a cylinder with given dimensions which is suitable for arrangement in the side tube of the tube lamp and is subjected to temporary sintering. Afterwards, in the center of the dielectric face an opening with a diameter roughly equal to the upholding parts of the electrodes is machined as far as into the electrically conductive area and formed.

Next, on the surface of the upholding parts of the electrodes which have an electrode at their tip, thin layer 9 is formed from a metal with a high melting point. This thin layer of a metal with a high melting point is formed by a vacuum evaporation method or a sputtering process. It is a good idea for this metal with a high melting point to be a material with a melting point which has at least the temperature in complete sintering of the functional gradient material. Among others, molybdenum or tungsten is suited for the thin layer on the surface of the upholding parts of the electrodes, because it has a high melting point and therefore no change such as melting, spraying, alloying or the like occurs at the temperature in complete sintering of the functional gradient material. After formation of the thin layer of metal with a high melting point on the surface of the upholding parts of the electrodes the latter are inserted into the above described temporarily sintered body, subjected to complete sintering and attached.

Since the bonding strength of the thin layer on the surface of the upholding parts of the electrodes is low, when the functional gradient material shrinks the particles which form the thin layer slide on the surface of the upholding parts of the electrodes, if in complete sintering in an area of the functional gradient material at least with a metal component of less than or equal to 50% by volume a gap to the upholding parts of the electrodes is formed due to the different coefficents of thermal expansion. In this sliding area there is no distortion as a result of deformation. Therefore on the surface of the area at least with one metal component of less than or equal to 50% by volume no cracks form either within the functional gradient material.

The area in which the thin layer is formed is inserted into the sealing body of the functional gradient material. If the thin layer is formed on the surface of the upholding parts of the electrodes which borders the inner area of the sealing body at least with a metal component of less than or equal to 50% by volume, the effect as claimed in the invention is achieved. The thin layer can furthermore also be formed on the surface of the upholding parts of the electrodes outside the sealing body. Since the opening of the sealing body has a diameter roughly equal to the upholding parts of the electrodes and has been subjected to a shrink seal during sintering, a gap does not form between the opening and the upholding parts of the electrodes. Therefore formation of the coolest portion here is prevented.

In this case a metal halide lamp, xenon lamp or mercury lamp can be used as the discharge lamp. The sealing body as claimed in the invention can furthermore also be used for a filament lamp such as a halogen lamp, a halogen heating apparatus or the like.

An opening of the sealing body consisting of the functional gradient material was described above, in which one end is closed. However there are also cases in which upholding parts of the electrodes penetrate the sealing body and are attached. It goes without saying that the invention can also be used for a through opening of the sealing body.

In the following one embodiment is specifically described.

A metal halide lamp with the same arrangement as in FIG. 1 was used. The diameter of sealing body 6 is 3.0 mm, and sealing body 6 consists of a functional gradient material which was produced by a pressing process and its raw materials are silicon dioxide and molybdenum. The molybdenum concentration on the two ends of the functional gradient material on the dielectric side is 0% by volume and on the electrically conductive side it is 80% by volume. Electrodes 4 and 5 consist of tungsten. Upholding parts 7 of the electrodes are formed in one part with electrodes 4 and 5, consist of tungsten, and have a diameter of 0.5 mm. Power consumption is 150 W. The filled substances are 19 mg mercury, 0.4 mg dysprosium iodide-neodymium iodide-cesium iodide and 0.25 mg indium bromide.

The thin layer of a metal with a high melting point consists of tungsten. To form the thin layer, there are a vacuum evaporation method, a sputtering process, an application process in which fine particles of a metal with a high melting point are mixed with a solvent, applied and dried, and a similar process. In the sputtering process the disadvantages are a large device and high costs. In the application process the disadvantage is that the layer thickness is difficult to monitor. In this embodiment therefore the vacuum evaporation method is used in which the device is small and the costs are low. The thickness of the tungsten layer formed was roughly 1 micron.

Evaporation was done using a tungsten rod shaped like a coil, with a wire diameter of 1 mm as the evaporation source when turned on for 10 minutes with a vacuum of $1\times10^{-5}$ Torr and a current value of 20 A.

In the following an experiment is described which shows the action of the invention.

Comparison of a lamp as claimed in the invention, i.e. a lamp in which the upholding parts of the electrodes are coated with a thin layer with a high melting point, to a conventional lamp, i.e. a lamp without coating of the upholding parts of the electrodes with a thin layer with a high melting point, was done. Both in the lamp as claimed in the invention and also in the conventional lamp five lamps at a time were used. Operation was done under the condition of a repetition cycle of 45 minutes operation in air and 15 minutes off as horizontal operation.

As a result of the experiment, in the conventional lamp after 45 minutes of operation in the sealing bodies of all lamps a leak occurred, causing cessation of operation. In the lamp as claimed in the invention on the other hand, even 1500 hours after starting of operation there was no malfunction.

As was described above, as claimed in the invention the dielectric area of the functional gradient material is in contact with the upholding parts of the electrodes via the thin layer of metal with a high melting point. The thin metal layer on the surface of the upholding parts of the electrodes therefore slides during sintering, and the shrink distortion is relieved. Therefore no cracks form and thus a good tube lamp is obtained. Furthermore, between the opening of the sealing body and the upholding parts of the electrodes there is essentially no gap. Therefore condensation of the substance with which the discharge lamp is filled can be prevented if the invention is used for a discharge lamp.

Commercial Application

As was described above, the sealing part arrangement as claimed in the invention (sealing body as claimed in the invention) can be used to advantage for a hermetically sealed arrangement of a discharge lamp such as a metal halide lamp, a mercury lamp or the like, and a filament lamp such as a halogen lamp or the like.

What we claim is:

1. Sealing body of a tube lamp which seals a side tube which is connected to an arc tube and which securely holds the upholding parts of the electrodes by a shrink seal and which consists of a functional gradient material, in which an electrically conductive component and a dielectric component in the axial direction of the tube have a continuous or gradual concentration gradient, and in which one side is dielectric and the other side is electrically conductive, characterized in that the upholding parts of the electrodes are located in an opening of the functional gradient material without a gap in a shrink seal, and that the surface of the area of the upholding parts of the electrodes which are located in the opening of the functional gradient material is coated at least partially with a thin layer of a metal with a high melting point.

2. Sealing body of a tube lamp as claimed in claim 1, wherein the metal with a high melting point is tungsten or molybdenum.

* * * * *